US006887414B2

(12) United States Patent
Oh et al.

(10) Patent No.: US 6,887,414 B2
(45) **Date of Patent: *May 3, 2005**

(54) METHOD FOR MANUFACTURING POLYESTER FIBERS

(75) Inventors: Duk-ho Oh, Ulsan (KR); Heyng-keyng Kim, Ulsan (KR)

(73) Assignee: Hyosung Corporation, Seoul (KR)

( * ) Notice: Subject to any disclaimer, the term of this patent is extended or adjusted under 35 U.S.C. 154(b) by 369 days.

This patent is subject to a terminal disclaimer.

(21) Appl. No.: 10/012,420

(22) Filed: Dec. 12, 2001

(65) Prior Publication Data

US 2003/0047834 A1 Mar. 13, 2003

(30) Foreign Application Priority Data

Sep. 7, 2001 (KR) ..... 2001-54974

(51) Int. Cl.[7] ..... D01D 5/092; D01D 5/16; D01F 6/62

(52) U.S. Cl. ..... 264/210.7; 264/210.8; 264/211.12; 264/211.14; 264/237

(58) Field of Search ..... 264/210.7, 210.8, 264/211.12, 211.14, 237

(56) References Cited

U.S. PATENT DOCUMENTS 5,433,591 A * 7/1995 Zingsem et al. .... 264/211.14 X
6,511,624 B1 * 1/2003 Cho et al. ..... 264/210.7

* cited by examiner

*Primary Examiner*—Leo B. Tentoni
(74) *Attorney, Agent, or Firm*—Greenblum & Bernstein, P.L.C.

(57) ABSTRACT

Method for manufacturing polyester fibers comprising melt-extruding a polymer without increasing an intrinsic viscosity of the polymer during spinning to minimize a reduction of the intrinsic viscosity of the polymer; maintaining a low atmospheric temperature directly below a nozzle to maximize a degree of orientation of undrawn yarn; winding the polymer at 2,000 m/min or more to produce a undrawn yarn, followed by drawing the undrawn yarn through continuous three phases at low temperature. The method has advantages in that high strength and low shrinkage polyester fibers with a uniform fineness and physical properties can be manufactured at high spinning efficiency, without formation of broken filament and curved filament, by preventing formation of a vortex of cooling air with the use of eddy plates directly below a nozzle.

6 Claims, 3 Drawing Sheets

PRIOR ART

METHOD FOR MANUFACTURING POLYESTER FIBERS

BACKGROUND OF THE INVENTION

1. Field of the Invention

The present invention relates to a method for manufacturing high modulus and low shrinkage industrial polyester fibers useful as materials for reinforcing rubber products, such as a tire and a belt, with high spinning efficiency so that polyester fibers have uniform physical properties.

Particularly, the invention pertains to a method for manufacturing polyester fibers comprising the steps of: melt-extruding a polymer without increasing an intrinsic viscosity IV of the polymer during spinning to minimize a reduction of the intrinsic viscosity of the polymer; winding the polymer at 2,000 m/min or more to produce an undrawn yarn, followed by drawing the undrawn yarn through three stages at a temperature of glass transition (Tg) or less; wherein polyester fibers with uniform fineness and physical properties can be manufactured with high spinning efficiency by setting eddy plates A directly below a nozzle. A dipped cord produced by twisting and dipping polyester fibers according to the present invention has a high strength and an excellent dimensional stability.

2. Description of the Prior Art

As well known in the art, high tenacity polyethylene terephthalate filaments are useful in industrial applications, such as a tire cord for reinforcing rubber, a seat belt, a V-belt, and a hose. Efforts have been made to improve physical properties of a high tenacity industrial yarn, in particular, a toughness of a treated cord and a dimensional stability, useful as a fiber reinforcement in a rubber tire.

Generally, a yarn having E-S of 7.0 to 8.0% and an excellent dimensional stability, used as materials for reinforcing rubber products such as a tire and a belt, which is used to manufacture a HMLS (High Modulus Low Shrinkage) dipped cord, is produced by extruding a molten polyester polymer through a nozzle, cooling the molten polyester through a solidification region, in which a separate heating device (e.g. a heated sleeve at 150 to 450° C.) is set, winding the resulting polyester at 2,000 m/min or faster, and drawing it at a temperature of glass transition (Tg) or higher, as shown in FIG. 3. According to the prior arts, a portion of cooling air passing through multifilament bundles forms a vortex directly below a nozzle. Also a portion of extruded filaments is rapidly quenched by the vortex to generate curved filament or fused filament to create an uneven fineness of a yarn and nonuniform physical properties of a yarn, and broken filament are formed due to nonuniform physical properties of filaments during the drawing, thereby a spinning efficiency is reduced.

SUMMARY OF THE INVENTION

It is therefore an object of the present invention to provide a method for manufacturing high modulus and low shrinkage polyester fibers having even fineness and uniform physical properties without forming broken filament and curved filament, by preventing a vortex of cooling air, with high spinning efficiency.

The present invention also relates to a method for manufacturing polyester fibers, comprising melting solid phase polymerized polyester chips having an intrinsic viscosity of 1.00 to 1.15 and a moisture regain of 30 ppm or less at 290 to 300° C., spinning the molten polyester through a nozzle and cooling extruded filaments with cooling air, winding the extruded filaments at a rate of 2,000 m/min or more to produce an undrawn yarn, and drawing the undrawn yarn, wherein at least one eddy plate is set at an upper position of a quenching zone below a nozzle, and the undrawn yarn is drawn through three phases at a temperature of glass transition of polyester polymer or lower.

The at least one eddy plate can comprise two eddy plates or three eddy plates.

The first drawing can be performed at a temperature of 50 to 70° C., a second drawing at a temperature of 50 to 70° C., and a third drawing at a temperature of 60 to 77° C.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
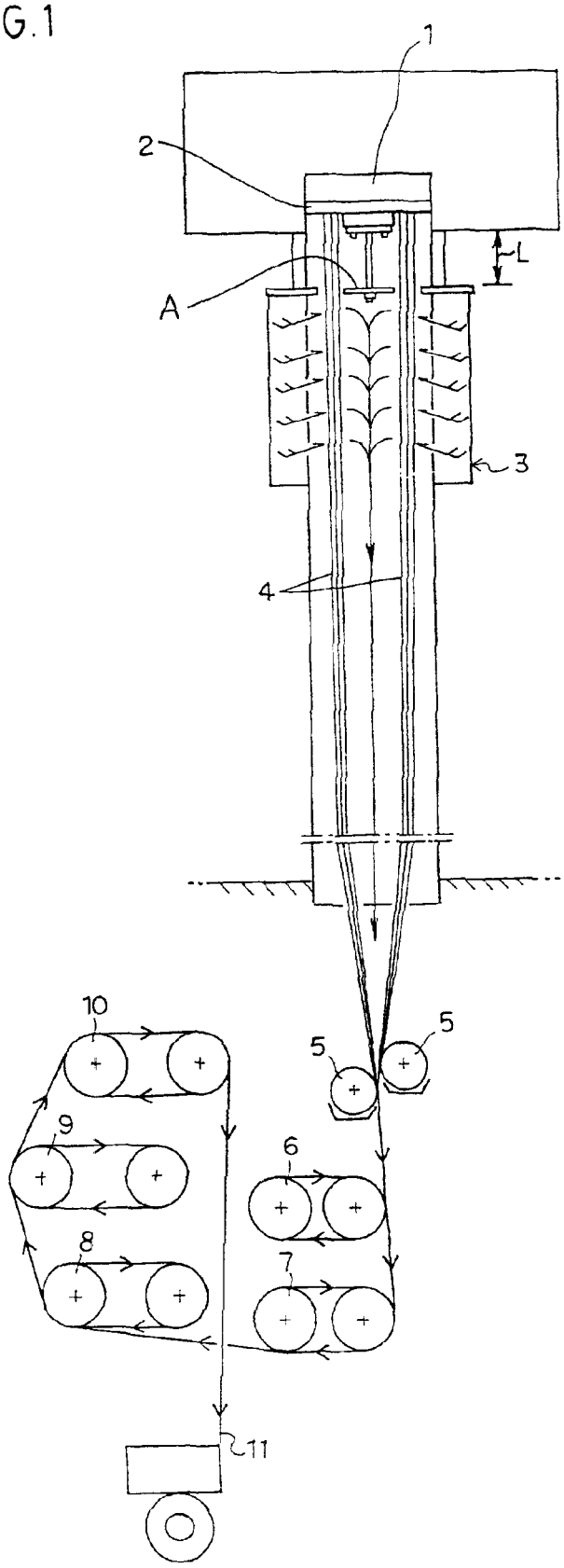
FIG. 1 schematically illustrates a method of manufacturing polyester fibers according to the present invention.

The application of the preferred embodiments of the present invention is best understood with reference to the accompanying drawings, wherein like reference numerals are used for same and corresponding parts, respectively.

With reference to FIG. 1, there is schematically illustrated a method of manufacturing polyester fibers according to the present invention. Solid phase polymerized polyester chips with an intrinsic viscosity IV of 1.00 to 1.15 and a moisture regain of 30 ppm or less are subjected to a melt spinning procedure in the presence of a polymerization catalyst, i.e. antimony compound, which is present in an amount of 250 to 400 ppm in the polymer. For example, when the amount is less than 250 ppm, a polymerization efficiency is lowered because of a low polymerization rate. On the other hand, when the amount is more than 400 ppm, a pack pressure and a contaminating rate of a nozzle are increased, i.e. an operating efficiency becomes poor because the catalyst is deposited after polymerization is completed.

A temperature of the molten polymer is controlled within a range from 290 to 300° C. so that a reduction of a viscosity of a discharged yarn due to a thermal decomposition and hydrolysis during the melt spinning step can be prevented, and its intrinsic viscosity is 0.94 to 1.02.

For example, when the moisture regain of chips according to the invention is more than 30 ppm, hydrolysis readily occurs during the spinning process, so that high modulus fiber cannot be obtained because an intrinsic viscosity of the fiber is reduced. Also, when the intrinsic viscosity IV of the chip is higher than 1.15, filaments are frequently cut during the spinning process, and spinning and drawing efficiency is reduced because a spinning tension is excessively increased owing to a spinning at a low temperature, and a cross sectional area of an extruded yarn is nonuniform.

A hood length L of is 40 to 120 mm and the extruded yarn 4 is passing through the hood maintained at 200 to 250° C.

until it reaches a quenching zone 3. After that, the yarn 4 is quenched through the quenching zone 3, oiled by an oiling device 5, and then drawn through three stages at a temperature of glass transition Tg of polyester polymer or lower with the use of five pairs of godet wheels 6 to 10 to produce a yarn 11 finally.

According to the present invention, eddy plates A are set in multifilament bundles at an upper position of a quenching zone 3 directly below a nozzle 2, so that the cooling air passing through multifilament bundles does not rise toward the nozzle 2 by eddy plates A but downwardly moves with multifilament bundles 4, and thus occurrence of a vortex is prevented, thereby solving a problem of prior arts.

Figure 2A:
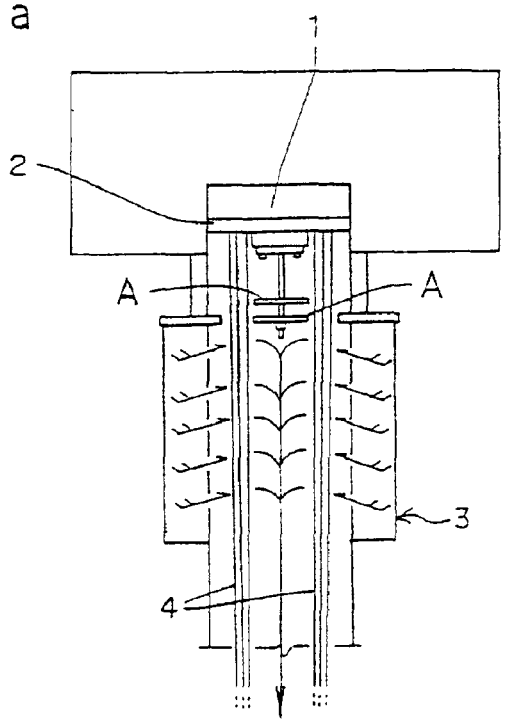
FIG. 2A illustrates the use of two eddy plates in manufacturing polyester fibers according to an embodiment of the present invention.
Figure 2B:
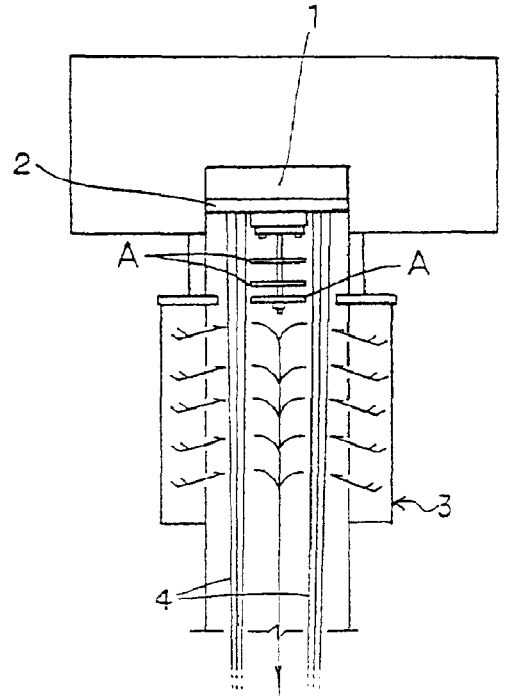
FIG. 2B illustrates the use of three eddy plates in manufacturing polyester fibers according to another embodiment of the present invention.

Alternatively, two or three eddy plates A may be used so as to more efficiently prevent formation of a vortex of cooling air, as shown in FIGS. 2A and 2B.

According to the present invention, a hood length L, which is a length from directly below the nozzle 2 to a quenching zone 3, is controlled within a range from 40 to 120 mm at an low temperature directly below the nozzle of 200 to 250° C., which is less than a melting point of polyester polymer, and filaments extruded from the nozzle 2 are cooled quickly so as to raise a solidification temperature without setting a separate heated sleeve directly below the nozzle 2.

As described above, the solidification temperature and the spinning tension of the discharged polymer is raised by lowering the temperature directly below the nozzle 2, and thus a tie chain is formed and a degree of orientation of undrawn yarn is increased, thereby a yarn with high strength and excellent dimensional stability can be produced.

Extruded filaments are wound at 2,000 m/min or more with the use of a godet roll 6 to 10 so that an orientation degree of an undrawn yarn can be within a range of 40×10−3, to 50×10−3. The filaments are drawn through three phases of a first drawing at a temperature of 50 to 70° C., a second drawing at a temperature of 50 to 70° C., and a third drawing at a temperature of 60 to 77° C., all of which are less than a temperature of glass transition of polyester polymer (78° C.), to produce a yarn 11.

For example, when the orientation degree of the undrawn yarn is less than $40\times10^{-3}$, the strength is largely reduced during the heat treating at dipping and E-S of a dipped cord is increased, so that a dimensional stability becomes poor. On the other hand, when the orientation degree is more than $50\times10^{-3}$, the yarn with a sufficient strength cannot be obtained because a maximum draw ratio is low.

Meanwhile, when a drawing temperature is more than the temperature of glass transition during the drawing step, a spinning efficiency and physical properties of a drawn yarn become poor because of formation of broken filament due to excessive crystallization in filaments.

According to the present invention, the yarn is controlled in the draw ratio so that the grey yarn has an intrinsic viscosity of 0.94 to 1.02, an amorphous orientation function (fa) of 0.70 to 0.80, Mi (Initial Modulus) of 93 to 120 g/d, Mt (Terminal Modulus) of 5 to 70 g/d, a tenacity of 6.5 to 9.3 g/d, an elongation of 11 to 18%, a shrinkage of 6 to 7.5%, a crystallinity of 47 to 51%, and a crystal size of 36 to 45 Å.

The dipped cord obtained from the yarn as described above has tenacity of 6.3 g/d or more, shrinkage of 3.0 to 4.5%, and a medium elongation of 3.0 to 4.0%, thereby dipped cord with high strength and excellent dimensional stability can be obtained.

Therefore, the present invention has advantages in that a solid phase polymerization energy needed for raising an intrinsic viscosity of the chip to the required level is reduced because the intrinsic viscosity of a polymer chip may not be higher than that of the polymer chip of the conventional method, and a uniform viscosity of polymer is increased by reducing a difference of viscosities between an interior side and exterior side of the chip, i.e. a disadvantage of the solid phase polymerization, thereby the spinning efficiency and physical properties of the final product are improved.

Moreover, other advantages of the invention are that a polymer is rapidly solidified by maintaining it at low temperature of 250° C. or lower directly below a nozzle, wound at 2,000 m/min or more, and a degree of orientation at undrawing is maximized, thereby polyester fibers with high strength can be produced at a relatively low draw ratio.

The yarn according to the present invention has a high tenacity, a low shrinkage, and a slightly reduced strength during the heat treating at dipping. And thus, a dipped cord produced by twisting, such as plying and twisting the yarn in two plys, followed by heat treating at dipping, has a high strength and a low shrinkage. Also, the dipped cord is useful as materials for reinforcing rubber products such as a tire and a belt, or other industrial materials.

EXAMPLE AND COMPARATIVE EXAMPLE

Solid phase polymerized polyester chips with an intrinsic viscosity IV of 0.65 and a moisture regain of 20 ppm are subjected to a melt spinning process in an extruder in the presence of a polymerization catalyst, i.e. antimony compound, which is present in an amount of 360 ppm in the polymer, and passed through a spinning pack, in which a static mixer with three units in each conduit is set, via spinning conduits to be spun through a nozzle at 500 to 600 g/min.

The extruded filaments are passed through a hood part at a distance of 100 mm directly below the nozzle and a quenching zone, in which air of 20° C. blows at a rate of 0.5 m/sec, to be solidified. Thereafter, the polymer is oiled, and wound by use of a godet wheel at 2,100 m/min, followed by being drawn through three phases comprising a first drawing at a temperature of 60° C., a second drawing at a temperature of 60° C., and a third drawing at a temperature of 75° C. with the use of other godet wheels.

After that, the yarn of 1000 denier is produced by relaxing by 2% and winding it.

Figure 3:
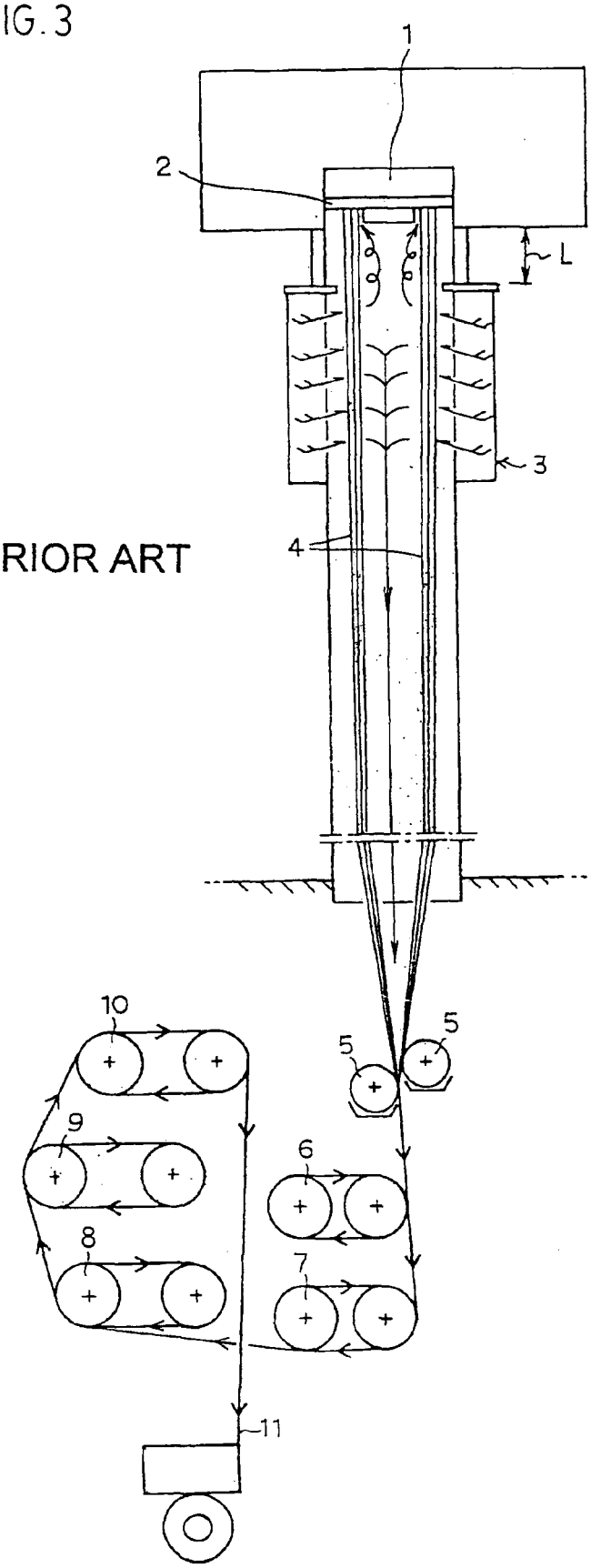
FIG. 3 schematically illustrates the conventional method of manufacturing polyester fibers.

According to an example of the present invention, an eddy plate A is set at a distance of 100 mm directly below a nozzle as shown in FIG. 1. On the other hand, in case of comparative example, no eddy plate is set as shown in FIG. 3. The results are described in Table 1.

TABLE 1

| | Tenacity (g/d) | Elong. (%) | Denier | Spinning Effi. | Eveness (u %) | Number of broken filaments/km |
|---|---|---|---|---|---|---|
| Example | 8.3(0.29) | 13.9 (1.28) | 1000 (11.3) | Good | 1.38(0.23) | 20 |
| C. Exam. | 8.3(0.50) | 13.9 (1.70) | 1000 (19.5) | Bad | 1.65(0.55) | 40 |

*( )is a standard deviation (δ).

As described above, the present invention has advantages in that a problem according to the conventional method, such as formation of broken filament and curved filament, can be avoided because formation of a vortex of cooling air directly below a nozzle is prevented by using the eddy plates A, and that high strength and low shrinkage industrial polyester fibers having an even fineness and physical properties can be produced with high spinning efficiency by drawing at low temperature.

The present invention has been described in an illustrative manner, and it is to be understood that the terminology used is intended to be in the nature of description rather than of limitation.

Many modifications and variations of the present invention are possible in light of the above teachings. Therefore, it is to be understood that within the scope of the appended claims, the invention may be practiced otherwise than as specifically described.

The present disclosure relates to subject matter contained in priority Korean Patent Application No. 2001-54974, filed on Sep. 7, 2001, the contents of which is herein expressly incorporated by reference in its entirety.

What is claimed is:

1. A method for manufacturing polyester fibers, comprising:

melting solid phase polymerized polyester chips having an intrinsic viscosity of 1.00 to 1.15 and a moisture regain of 30 ppm or less at 290 to 300° C., spinning the molten polyester through a nozzle and cooling extruded filaments with cooling air, winding the extruded filaments at a rate of 2,000 m/min or more to produce an undrawn yarn, and drawing the undrawn yarn, wherein at least one eddy plate is set at an upper position of a quenching zone below a nozzle, and the undrawn yarn is drawn through three phases at a temperature of glass transition of polyester polymer or lower.

2. The method according to claim 1, wherein the at least one eddy plate comprises two eddy plates.

3. The method according to claim 1, wherein the at least one eddy plate comprises three eddy plates.

4. The method according to claim 1, wherein a first drawing is performed at a temperature of 50 to 70° C., a second drawing at a temperature of 50 to 70° C., and a third drawing at a temperature of 60 to 77° C.

5. The method according to claim 2, wherein a first drawing is performed at a temperature of 50 to 70° C., a second drawing at a temperature of 50 to 70° C., and a third drawing at a temperature of 60 to 77° C.

6. The method according to claim 3, wherein a first drawing is performed at a temperature of 50 to 70° C., a second drawing at a temperature of 50 to 70° C., and a third drawing at a temperature of 60 to 77° C.

* * * * *